United States Patent [19]

Simpson et al.

[11] 4,345,507

[45] Aug. 24, 1982

[54] ELEVATOR FLUID FLOW CONTROL VALVE

[75] Inventors: Elmer J. Simpson, Margate; Glen A. Rued, Pompano, both of Fla.

[73] Assignee: Elevator Equipment Co., Los Angeles, Calif.

[21] Appl. No.: 127,767

[22] Filed: Mar. 6, 1980

[51] Int. Cl.[3] ..... F15B 13/044

[52] U.S. Cl. ..... 91/449; 91/48; 251/174

[58] Field of Search ..... 91/48, 449; 137/870, 137/877, 881; 187/29 A, 29 B; 251/174

[56] References Cited

U.S. PATENT DOCUMENTS 2,538,928 1/1951 Wood ..... 91/449 X 3,141,386 7/1964 Loughridge ..... 91/449 X

*Primary Examiner*—Gerald A. Michalsky

*Attorney, Agent, or Firm*—Vernon D. Beehler

[57] ABSTRACT

A fluid flow control valve system to be used to control a hydraulic lifting mechanism used on elevators and the like. The valve system includes an inlet conduit from the pump and an inlet-outlet to and from a jack connected together by a conduit with a one-way valve operable in the direction from the pump to the jack, a first by-pass chamber connected to the pump side of the one-way valve and a second by-pass chamber connected to the jack side of said one-way valve, outlets to the pump sump from each by-pass chamber, and a movable gate control mechanism for controlling the exit of pressurized fluid from the first by-pass chamber or the second by-pass chamber through the outlets to the pump sump. Hydraulic fluid from the pump when the first chamber is sealed, passes through the one-way check valve. When the second chamber is also sealed, the fluid will provide pressure to a jack to lift a load. With the first chamber gate opened at least a portion or all of the fluid passes back to the sump. This slows or stops the fluid flow to the jack. The jack cannot lower because the gate control mechanism to the second chamber is closed. When the second chamber gate opening in the chamber connected to the jack is opened, the weight of the load puts pressure on the fluid forcing it to be discharged through the chamber back to the tank or sump. This lowers the load.

6 Claims, 8 Drawing Figures

MOTOR
PUMP
SUMP

ELEVATOR FLUID FLOW CONTROL VALVE

BACKGROUND OF THE INVENTION

Hydraulic pistons have provided a simple and inexpensive means for lifting loads, but existing systems incorporate valves with small needle orifices that can become blocked or partially blocked with foreign particles in the oil resulting in restriction in normal oil flow in the control section of the valve. This can cause elevator travel while the doors are open. The electric control circuit shows the elevator has stopped but the mechanics of the valve (control oil system) have not performed properly and in actuality the elevator has not stopped, it continues to travel with doors open.

Present systems that include valves also have temperature, pressure and viscosity oil problems.

BRIEF SUMMARY OF THE INVENTION

A system for controlling a hydraulic piston lifting mechanism comprising in one embodiment an elongated cylinder sealed at each end by bolted-on plates, a barrel containing a divider plate which separates the cylinder into two chambers, two generally cup-shaped gates on each side of the divider with holes in them for a control shaft and with a gate structure such that they can be rotated into positions where the opening in the gate will conduct fluid into an opening connected to a sump or tank. The shaft running through the elongated cylinder allows automatic or manual operation in an emergency. The hydraulic piston is directly connected to the pump through a one-way valve. Each side of the one way valve is connected to a different chamber.

The valve system or systems includes an inlet conduit from the pump and an inlet-outlet to and from a jack connected together by the conduit with a one-way valve operable in the direction from the pump to the jack. The first by-pass chamber connected to the pump side of the one-way valve and the second by-pass chamber connected to the jack side of said one-way valve, outlets to the pump sump from each by-pass chamber, and a movable gate control mechanism for controlling the exit of pressurized fluid from the by-pass chambers through the outlets to the pump sump. The hydraulic fluid is pumped into the line connected to the first chamber and a one-way check valve. When the first chamber is sealed, all the fluid passes through the check valve. The exit end of the one-way check valve is connected to a second chamber and connected to the jack. If the second chamber is also sealed, the fluid will provide pressure to a jack which lifts a load. When the first chamber gate connected to the pump opens, a portion or all of the fluid coming from the pump passes through the gate opening and is discharged back to the sump. This slows or stops the fluid flow to the jack by way of the one-way check valve and therefore, it slows or stops the load movement.

When the gate opening in the second chamber connected to the jack is opened, the weight of the load puts pressure on the fluid forcing it to be discharged through the hole in the second chamber back to the tank or sump. This lowers the load.

For emergency use, the gate in the second chamber can be manually closed or opened slightly to stop the load or lower the load slowly; or the gate in the first chamber may be opened to prevent run away movement of the load.

It should be noted that by varying the size of the output to the sump by movement of the shaft one may vary the speed of flow and therefore vary the jack speed.

An object of the invention is to provide a non-complex valve system to control a hydraulic piston lift.

Another object of the invention is to provide a means of safely lowering a load in an elevator in case of emergency where the power is lost.

It is an object to provide a safety device by means of a compensating weight the valve will come to neutral (closed) position in the event of power loss.

It is an object to provide a safety device by means of electrical capacitance we are creating an electric safety in that the capacitor discharges and returns the valve to neutral.

In accordance with these and other objects which will be apparent hereinafter, the instant invention will now be described with particular reference to the accompanying drawings.

DESCRIPTION OF THE PREFERRED EMBODIMENT

Figures 1, 3:
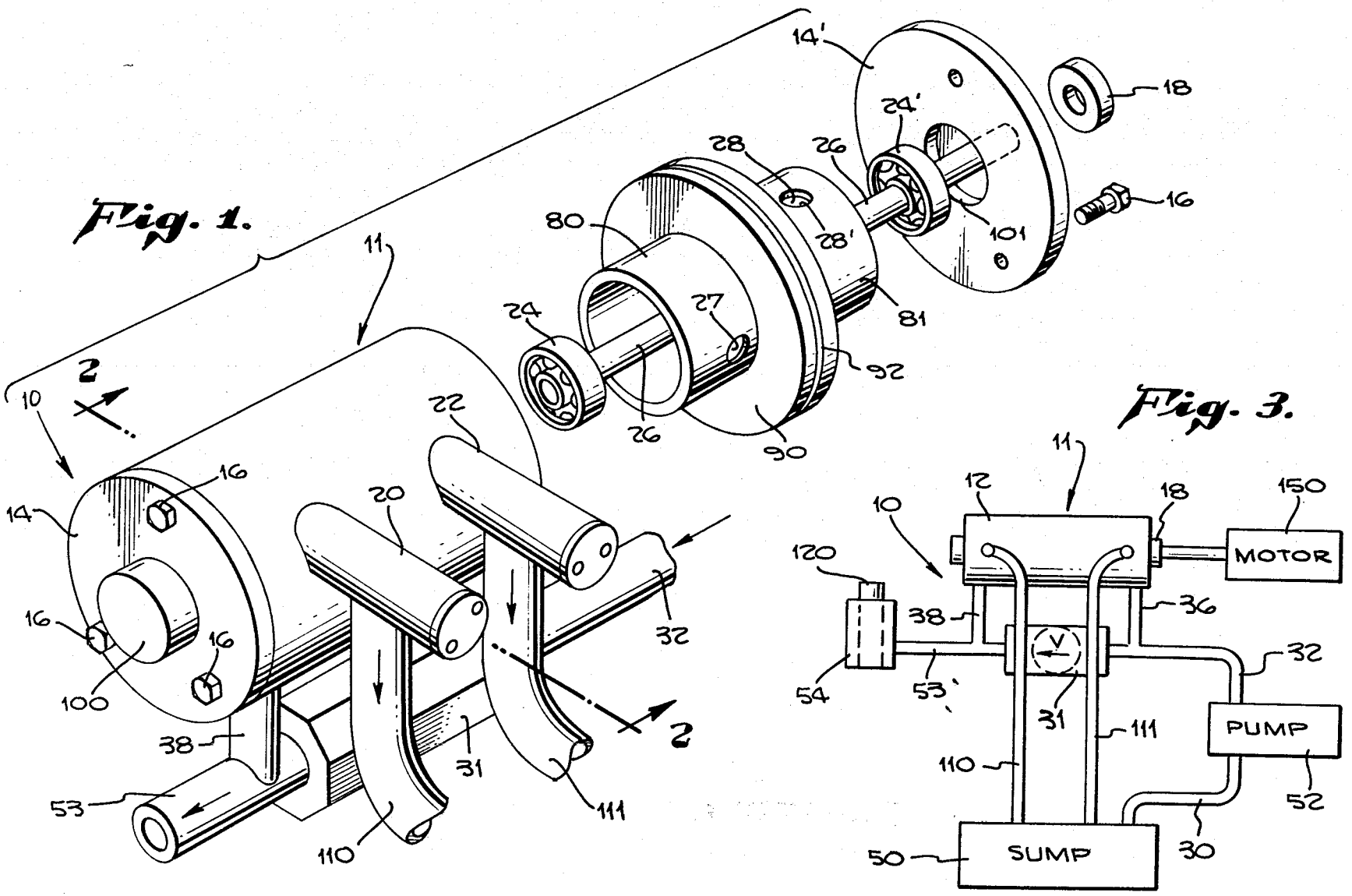
FIG. 1 is an isometric exploded view of the valve with the inner mechanism outside of the casing.
FIG. 3 is a block diagram of the valve system.

Referring to FIG. 1, the valve is designated by numeral 10 and includes a main body 11 of the fluid valve 10 in the form of an elongated cylindrical chamber having sealing plates 14 and 14' attached to each end by bolts 16. The cylindrical chamber having left and right-hand compartments 12 and 12', as viewed in FIG. 5, has a shaft 26 running through it with handle 18 at one end. It also has two taps 20 and 22 protruding from its side, FIG. 1, for discharging fluid back to the tank or sump 50 shown in FIG. 3. A pump 52 is connected to sump 50 by pipe 30 and to a check valve 31 as shown in FIGS. 1 and 3. Pipe 53 is connected between jack 54 and check valve 31. The one-way valve or check valve 31 is connected between line 36 and line 38 to the cylinder 11.

Figure 5:
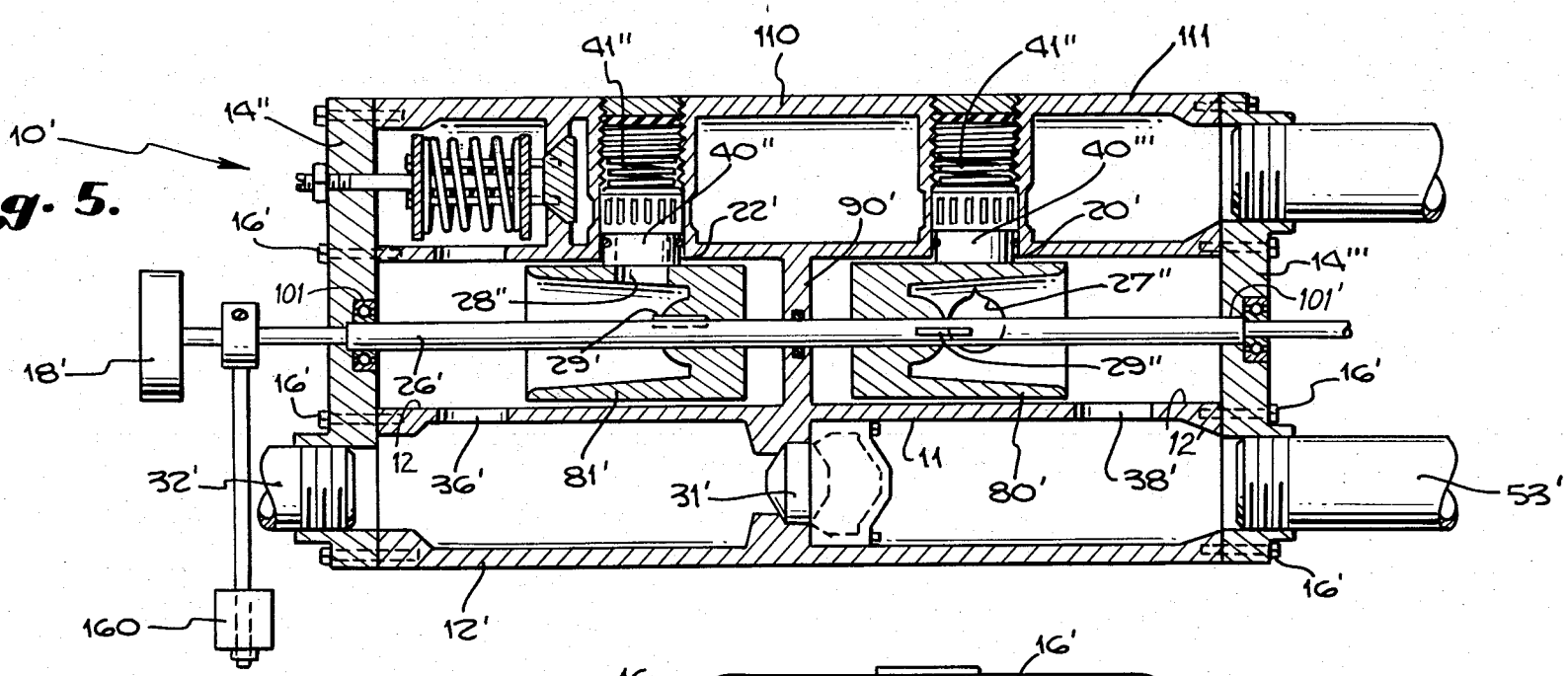
FIG. 5 is a cross-sectional side view of FIG. 4.

The cylindrical chamber shown in FIG. 5 has a divider wall 90 between the pump side and jack side. The wall 90 may be included in the body 11 or held by snap rings 91 shown in FIG. 2 on each side and with o-ring 92 sealing the outer perimeter as shown in FIG. 1. The center of the wall 90 has an opening for the shaft 26 and a conventional "O" ring seal to pass through and rotate therein.

Figure 2:
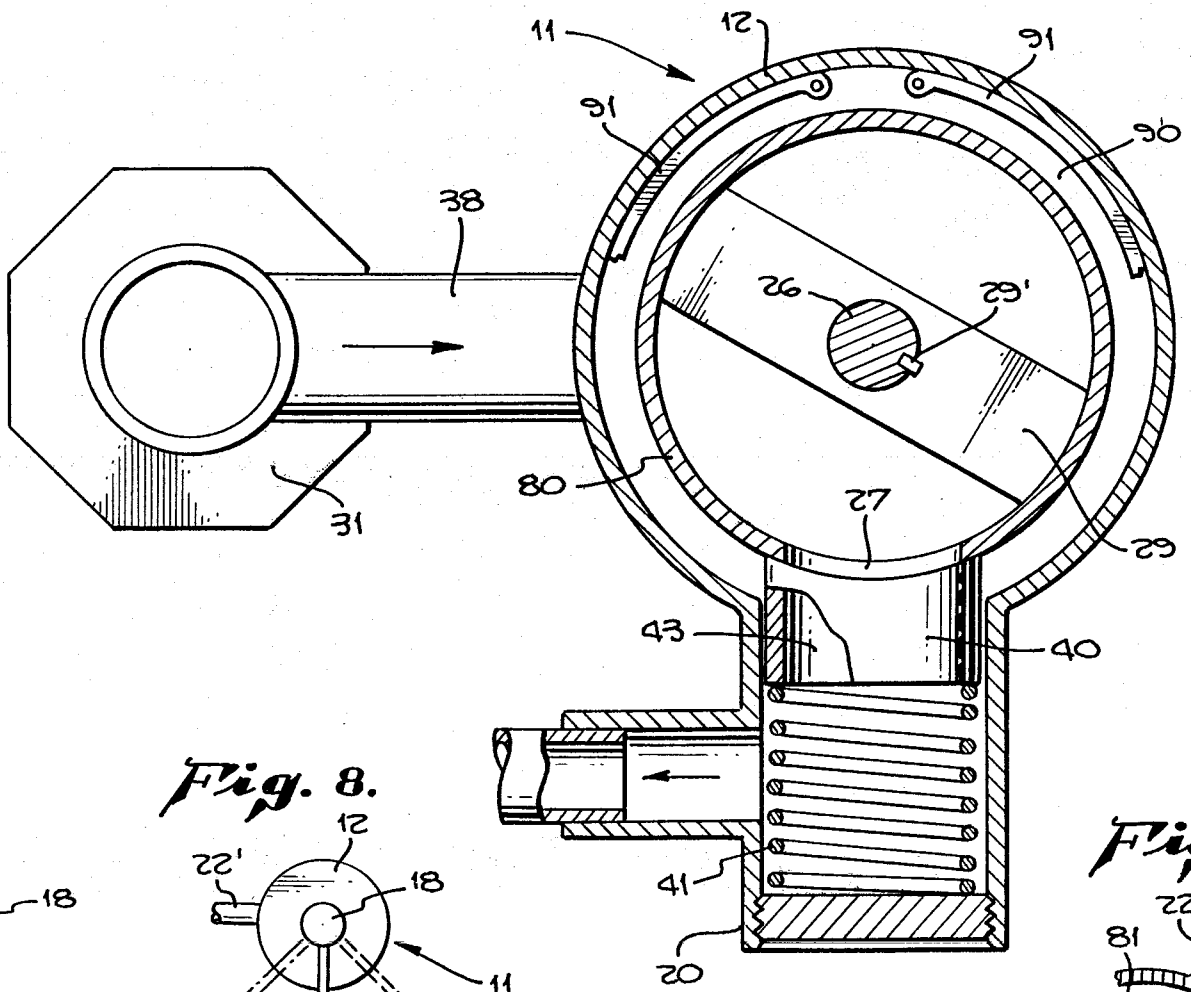
FIG. 2 is a cross-sectional end view of the valve shown in FIG. 1 taken along line 2—2 looking in the direction of the arrows.

Now referring to FIGS. 1 and 2, each of the taps 20 and 22 also contain springs 41 which push a wiping sleeve 40 having an opening 43 therethrough against the side of an inner gate 27 and 28. The gates are best shown in FIG. 1. The gates are in gate members 80 and 81 connected to the shaft 26 and a key 29. The brace is keyed to the shaft by key 29' prime. The gate is cup-shaped having a body portion 80' that is used to seal the opening 43 of the wiping sleeve 40'''. When the cup-shaped body portion 80 of FIG. 2 is rotated 45 degrees or more as shown it will seal the opening. Each gate member 80 and 81 has holes or openings 27 and 28 located on their sides such that as the shaft 26 is rotated such that either opening 27 or 28 can coincide or align with one of the wiping sleeve openings 43 but such that both cannot align with both wiping sleeves 40 simultaneously. The design may be such that partial alignment is desired. The gate member 80 and 81 can be positioned to block the passage of fluid through both sliding wiping sleeves 40 at once by rotating the handle 18 and shaft 26.

The shaft 26 is rotated by means of a shaft handle 18 or automatically by electrically controlled drive means or motor 150 well known in the art. The shaft 26 rotates in a hub opening 100 or hub opening 101 at each end of the cylindrical chamber. The shaft 26 has a roller bearing 24 and 24' at the ends to facilitate rotation in the hub of the shaft 26.

The divider 90 is at the center between compartments 12 and 12'. The shaft is held at the center between tap 20 and tap 22 and between line 36 from the pump and line 38 from the jack by the snap rings 91. An "O" ring is placed in the edge of the divider 90 to provide a seal between each side of the cylindrical chamber as shown in FIG. 1. Divider 90 divides the main cylinder into two chambers; an "up" chamber about gate opening 28 and a "down" chamber about gate opening 27.

Parallel to the length of the cylindrical chamber is a conduit which conducts fluid from the pump 52, through pipe 32 to the jack 54 by way of pipe 53. At the center of this conduit is the one-way check valve 31 which will conduct fluid in the direction from the pump 52 to the jack 54 only. The end of the pipe 32 connected to the pump 52 is also connected to the "up" chamber through line 36. The end of pipe 53 connected to the jack 54 is also connected to the "down" chamber through line 38.

To operate in the "up" mode, the pump 52 is turned on. The shaft 26 is rotated such that both gates 28 and 27 block the passage of fluid through both of the taps 20 and 22 into the sump 50 by lines 110 and 111. Therefore, the only route for the fluid coming from pump 52 is through the check valve 31 into the jack mechanism 54 forcing a piston 120 up. The jack may be used to raise and lower an elevator.

To operate in the "down" mode, the shaft 26 is rotated into a position where the opening 43 in wiper sleeve 40 and gate 27 coincide to allow fluid to flow into tap 20 such that the fluid flowing from line 38 into the down chamber will flow out of the second chamber or down chamber through line 110 and discharged back into the sump 50. This discharge from the jack allows the piston 120 to retract and the load to descend.

When the shaft 26 is rotated such that the opening 28 on the up gate member 81 coincides with the wiping sleeve (which is identical to wiper sleeve 40 and spring 41 shown in FIG. 2) in tap 22 the fluid or liquid coming from line 36 and the pump 52 into the up chamber or first chamber is discharged out through gate 28 and tap 22 back to the sump or tank 50. This removes the pressure on check valve 31 which stops the fluid flow to the jack 54, hence stopping the load at a particular stop position. An elevator would therefore remain fixed at a particular height on piston 120.

Figure 6:
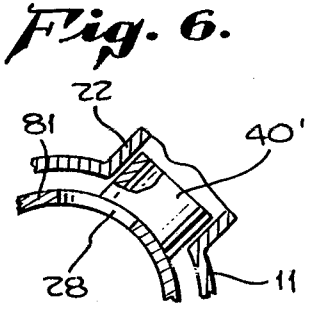
FIG. 6 is an enlarged partial cross-sectional view of a partially open chamber gate.

As the shaft 26 is rotated away from this stop position position, the load will be lifted up slowly by reducing flow of fluid out the tap 22 and thereby starting and increasing flow of fluid to the jack through the one-way check valve 31. This occurs when opening 43 in wiper sleeve 40' is partially blocked by the gate member 31 as shown in FIG. 6. The gate on the jack side may also be positioned in an overlap or intermediate open position to pass fluid out of the tap 20 through the wiping sleeve 40 to provide an intermediate jack lowering speed.

The opening and taps may be positioned to provide some flow of fluid out both taps at the same time to provide additional design features. For example gate opening 28 may be elongated in a direction toward opening 27, that is edge 28', see FIG. 1, would be elongated.

In case of power failure, the shaft handle 18 can be rotated such that the down gate member 80 either blocks fluid flow through the tap 20 and wiping sleeve or slowly allows the fluid to discharge back into the sump or tank 50 through the tap 20 and wiping sleeve. Thus, the load may be either stopped or descended slowly by manual operation.

Figure 4:
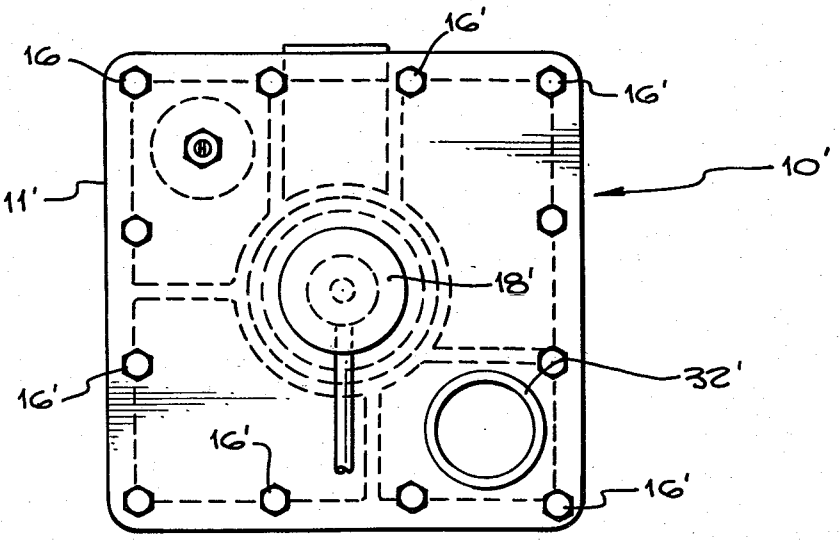
FIG. 4 is an end view of another embodiment of the valve.

Referring now to FIGS. 4 and 5, the valve is designated by numeral 10' and includes a body 11' of the fluid 10 in the form of an elongated cylindrical chamber having sealing plates 14'' and 14''' attached to each end by bolts 16'. The cylinder has a shaft 26' running through it with handle 18' at one end. It also has two taps 20' and 22' from the top for discharging fluid back to the tank or sump 50 shown in FIG. 3. The check valve 31' is between pipe 32' and pipe 53'. The one-way valve or check valve 31' is also connected between conduit 36' and conduit 38' to the first cylinder chamber and the second cylinder chamber respectively.

The body 11' has a divider wall 90' between the pump side and jack side. The wall 90' may be welded in the body or cast in the body chamber. The center of the wall 90' has an opening for the shaft, bearing and seals. The shaft passes through and rotates therein.

Referring to FIGS. 4 and 5, each of the taps 20' and 22' also contain springs 41'' and 41''' which push a wiping sleeve 40'' and 40''' having an opening therethrough against the side of an inner gate 27'' and 28''. The gates are in gate members 80' and 81' connected to the shaft 26'. The gate members as keyed to the shaft by key 29' and 29''. The gate is cup-shaped having a body portion that seals the openings in the wiper members. Body of FIG. 2 is rotated 45 degrees. The operation is the same as the device shown in FIGS. 1, 2 and 3.

Figure 8:
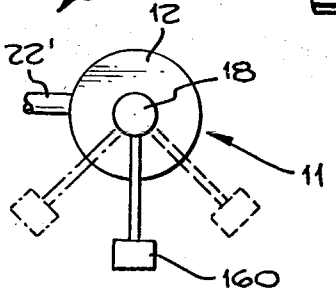
FIG. 8 is an end view of FIG. 7.
Figure 7:
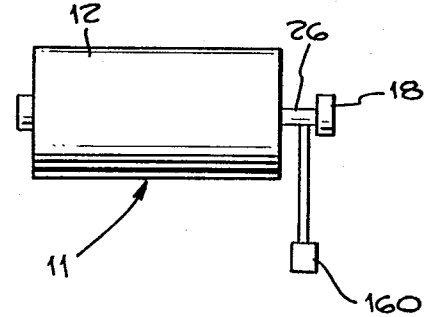
FIG. 7 is a side view of the cylinder with an automatic weight control.

FIGS. 7 and 8 show the automatic weight on the arm connected to shaft 26. When the shaft is released from manual operation or motor driver operation the weight will be moved to the lower position by the force of gravity to a neutral position. When in this position the opening in the cup-shaped gate members may be designed so that when the arm and weight 160 are in the position shown in FIGS. 7 and 8 the jack will be automatically stopped because opening 28 or 28'' is aligned with opening in 22 or 22', allowing the fluid to flow to the sump. This design will close port or conduit 20 or 20'.

The arm and weight may be replaced by an endless chain around the shaft and a sprocket with a weight positioned to provide the same automatic stopping of the jack.

The presently disclosed valve because of the design has no critical temperature limitation or required adjustments, pressure limitation or required adjustments, and various viscosities may be used with effective operation of the valve.

The weight safety means may operate when torque motor 150 looses power and free wheeling. Also the capacity or capacitors in the torque power supply (not shown) may be designed to provide power through the discharge of the capacitors to actuate the motor to drive the shaft to the neutral position as explained above.

The instant invention has been shown and described herein in what is considered to be the most practical and preferred embodiment. It is recognized, however, that departures may be made therefrom within the scope of the invention and that obvious modifications will occur to a person skilled in the art.

What I claim Is:

1. A hydraulic control valve system comprising: a body including a first chamber compartment with an inlet port and an outlet port and a second chamber compartment with an inlet port and an outlet port; first and second gate means rotatably mounted in said body for opening and closing respective outlet ports; drive means in operative engagement with the gate means adapted to rotate said gate means between open and closed positions, said drive means including external actuating means; wiper seal means in said first chamber compartment acting between said first gate means and the respective outlet port for providing a seal for the respective outlet port; wiper seal means in said second chamber compartment acting between the second gate means and the respective outlet port for providing a seal for the other outlet port; a hydraulic actuated jack, a supply of hydraulic fluid under pressure, a fluid conduit connected at one end to said fluid supply and at the other end adapted to be connected with said inlet ports and said jack, there being an intermediate one-way valve in said conduit having an open position allowing flow of fluid from said supply to said other end, said fluid conduit including by-pass means connected between a point upstream of said one-way valve and the inlet for said first chamber and between a point downstream of said one-way valve and the inlet of said second chamber.

2. A hydraulic control valve system as set forth in claim 1 wherein: each said gate means includes a hollow cylindrical member with at least one port; said drive means including a rotatable shaft; each said gate means being connected to said shaft.

3. A hydraulic control valve system as set forth in claim 2 wherein: said cylindrical members are connected to said shaft at different positions of rotation relative to each other whereby to synchronize opening and closing said ports at different positions of rotation of said shaft.

4. A hydraulic control valve system as set forth in claim 2 wherein: said wiper seal means includes a sleeve movable toward and away from said outlet port and biasing means acting in a direction whereby to bias said sleeve toward said cylindrical member, said sleeve having one end with a shape complementary to the outside of said cylindrical member and extending around said port whereby to redirect fluid emerging from the respective port, there being an automatic self-positioning means on each said gate means responsive alternatively to upstream pressure changes and downstream pressure changes, whereby said valve is operable under varying temperatures, pressures and oil viscosities without requiring adjustment.

5. A hydraulic control valve system as in claim 4 wherein there is a torque bias means acting on said gate means and adapted to move said gate means to positions wherein there is no flow of hydraulic fluid from said jack.

6. A hydraulic control valve system as in claim 5 wherein said drive means comprises a rod rotatably mounted relative to said body and there is a torque bias means comprising a weight element having an attachment to said rod at a location eccentric with respect to the axis of rotation, rotation of said rod by said weight element being adapted to move said gate means to positions wherein there is no flow of hydraulic fluid from said jack and flow of hydraulic fluid from said pump is by-passed from said jack.

* * * * *